US006401591B1

(12) United States Patent
Ross et al.

(10) Patent No.: US 6,401,591 B1
(45) Date of Patent: Jun. 11, 2002

(54) NEUTRALIZATION CHEMICAL INJECTION PENETRATOR

(75) Inventors: Jonathan R. Ross; Victor J. Carlson, both of Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 44 days.

(21) Appl. No.: 09/755,689

(22) Filed: Jan. 4, 2001

(51) Int. Cl.[7] ..... B64D 1/04
(52) U.S. Cl. ..... 89/1.13; 102/399; 102/402
(58) Field of Search ..... 89/113; 102/402, 102/293, 512, 426; 86/50, 49

(56) References Cited

U.S. PATENT DOCUMENTS

| | | | | | |
|---|---|---|---|---|---|
| 2,925,038 | A | * | 2/1960 | Walker | 102/302 |
| 3,386,381 | A | * | 6/1968 | Ferb | 102/502 |
| 3,584,582 | A | * | 6/1971 | Muller | 102/502 |
| 3,763,786 | A | * | 10/1973 | MacDonald | 102/512 |
| 3,837,284 | A | * | 9/1974 | Waldeisen | 102/512 |
| 3,893,866 | A | * | 7/1975 | Hollingsworth | 102/512 |
| 3,901,158 | A | * | 8/1975 | Ferb | 102/502 |
| 4,036,140 | A | | 7/1977 | Korr et al. | 102/38 |
| 4,046,055 | A | | 9/1977 | McDanolds et al. | 86/1 B |
| 4,493,239 | A | * | 1/1985 | Pedersen | 102/426 |
| 4,770,102 | A | | 9/1988 | Bisping et al. | 102/521 |
| 4,777,882 | A | | 10/1988 | Dieval | 102/489 |
| 4,863,428 | A | * | 9/1989 | Chevalier | 102/512 |
| 4,955,939 | A | * | 9/1990 | Petrousky et al. | 102/306 |
| 5,136,920 | A | * | 8/1992 | Breed et al. | 102/430 |
| 5,223,666 | A | * | 6/1993 | Delaney, Jr. | 102/306 |
| 5,460,154 | A | * | 10/1995 | Mattern et al. | 124/56 |
| 5,821,450 | A | * | 10/1998 | Fedida | 102/370 |
| 5,936,184 | A | | 8/1999 | Majerus et al. | 89/1.13 |
| 6,006,644 | A | * | 12/1999 | Matsuo et al. | 37/303 |
| 6,202,531 | B1 | * | 3/2001 | Comeyne | 89/1.13 |
| 6,298,763 | B1 | * | 10/2001 | Greenfield et al. | 102/402 |
| 6,308,607 | B1 | * | 10/2001 | Woodall et al. | 102/402 |

* cited by examiner

*Primary Examiner*—Michael J. Carone
*Assistant Examiner*—Denise Buckley
(74) *Attorney, Agent, or Firm*—Mark Homer

(57) ABSTRACT

The present invention comprises a device for clearing mines comprising a housing assembly with a chamber therein that carries a surface contact chemical that is capable of consuming the explosive fill within a mine. A nose assembly is attached to the housing assembly. The nose assembly separates from the housing assembly when the device contacts a solid mass. The nose assembly is capable of penetrating a mine housing and contacting the mine explosive fill sufficiently to expose the fill whereby the surface contact chemical can consume the fill. The present invention also includes a method of using a plurality of such devices in order to conduct a mine clearance operation in a surf zone or on a beach.

19 Claims, 3 Drawing Sheets

NEUTRALIZATION CHEMICAL INJECTION PENETRATOR

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to a device and method capable of quickly clearing mine fields. More particularly, the present invention pertains to a device and method of quickly clearing anti-tank and anti-invasion mines within beach and surf zones. This device is capable of neutralizing targets containing an energetic fill, such as unexploded ordnance, energetic material storage tanks, or magazines, etc. The present invention comprises a flechette penetrator, containing a chemical neutralizing agent, that can kinetically damage TNT within anti-tank and anti-invasion mines to obtain the required surface area necessary for the chemical nuetralizing agent to react with the TNT, either neutralizing or destroying the mines.

2. Brief Description of the Prior Art

Several inventions for neutralizing unexploded ordnance (UXO) have been patented. U.S. Pat. No. 4,046,055 discloses an apparatus for nuetralizing UXO by penetrating the UXO and injecting the UXO with liquid nitrogen in order to cool the fuse of the UXO to below its operating temperature. This apparatus is designed to neutralize only one UXO at a very small stand off distance because the penetrating mechanism is connected a tank of liquid nitrogen. Therefore, personnel would be required to approach the UXO in order to use the device.

U.S. Pat. No. 4,955,939 discloses a shaped charge device that penetrates a UXO and injects a disruptive material such as water, latex or gelatin to deactivate the detonator of the UXO. This device must also be positioned in front of the UXO by personnel in order to use the device.

U.S. Pat. No. 5,936,184 discloses a device having a shaped charge containing reservoirs of reactive material. The device penetrates the UXO by detonation of the shaped charge and injects the reactive material into the UXO, through gases generated by the shaped charge explosion, in order to neutralize the UXO so it does not detonate. Again, this device must be placed in front of a UXO by personnel in order to operate the device. This device is also designed to neutralize the UXO without detonating said UXO.

The major problems associated with these patented inventions are that they have been designed to neutralize one specific UXO due to the fact that they must be physically placed in front of the UXO in order to operate. These devices use energetic material that must be individually fuzed to operate. Also, they have been designed to neutralize the UXO and not detonate the UXO. This is due to the fact that personnel must be so integrally involved in the operation. For large mine clearance operations, however, neutralization or detonation of the mines are appropriate, as long as no further hazard exists for personnel entering an area after the mine clearance operation has been completed.

Several mine clearance systems have also been developed by the Navy and Marine Corp to explosively neutralize mines. These systems include Distributed Explosive Technology (DET) arrays, Shallow Water Assault Breaching (SABRE) line charges and M58 line charges. The DET system consists of a 180 foot by 180 foot detonating cord array and is deployed using two rocket motors. The SABRE system is a 400 foot long line charge, composed of 130 15-pound explosive loaded charges. This system is deployed using a single rocket motor. The M58 line charge is a 350 foot long line charge, composed of 2.5-pound plastic explosive blocks. This system is deployed using a single rocket motor. Both the DET and SABRE systems are used to clear mines in the surf zone between the high water mark on a beach and a 10 foot water depth. The M58 system is used to clear mines only on land. There are problems associated with each of these systems. First, these systems use bulk explosives to neutralize mines and the effectiveness of each system is limited to the specific land or sea conditions for which each system was developed. Second, these systems have large logistic footprints, require rocket motors for deployment, and are extremely heavy (between 2000 and 4000 pounds). Also, because of the deployment technologies required for these systems, the DET and SABRE systems are deployed from landing craft, air cushioned vehicles and the M58 system is launched from a trailer attached to a tracked vehicle, personnel are required to be present, and, therefore, could be subject to hostile fire. All of these systems have limited stand-off capability (less than 600 feet from launch point) and have limited operational capability in adverse weather conditions.

SUMMARY OF THE INVENTION

Due to the limitations of the current technology described above, a device is required by the military to enable the quick, efficient clearance of surf zones and beach zones containing mines. The present invention addresses this requirement. The invention is a device for clearing containers having hazardous fills comprising a housing assembly with a chamber therein that carries a surface contact chemical that, upon reaction with the hazardous fill within the container, the hazardous fill is consumed via combustion, deflagration, explosion, or detonation. A nose assembly is attached to the housing assembly. The nose assembly separates from the housing assembly when the device contacts a solid mass. The nose assembly is capable of penetrating a mine housing and contacting the hazardous fill sufficiently to expose the fill whereby the surface contact chemical can react with the fill, causing the fill to be consumed. The device is capable of clearing mines or other hazardous filled containers that are located under water, on the surface, or buried on land or on a beach. The device operates in the following manner. The device is propelled toward a mine. The nose assembly of the device would contact the container. When the nose assembly contacts the container, the housing assembly of the device would separate from the nose assembly. This gives the surface contact chemical the ability to flow. The nose assembly would penetrate the container and contact the hazardous fill within the container. This exposes the hazardous fill sufficiently to react with the surface contact chemical. The surface contact chemical will continue to flow behind the nose assembly, due to the momentum working on the device, until the chemical reacts with the hazardous fill, causing the hazardous fill to be consumed, ending the hazard. When dealing with mines, it is also possible that the nose assembly can impact the fuze assemble of the mine directly, and either activate and spend the mine or render the fuze mechanism inoperable, thereby neutralizing the mine.

The present invention also includes a method of using a plurality of such devices in order to conduct a mine clearance operation in water, on land, or on a beach. Many of the devices may be propelled from a large stand-off distance due to the small size of the device. To clear a surf or beach zone containing multiple mines, a sufficient number of devices are propelled toward the area to ensure that each mine is penetrated by at least one device as described above. This allows the area to be rendered safe for military personnel and equipment to land.

Accordingly, it is the object of this invention to neutralize containers having hazardous fills.

It is a further object of this invention to neutralize or destroy mines in water, on land or buried in sand.

This invention accomplishes these objectives and other needs related to neutralizing and detonating containers having hazardous fills.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

The present invention is a clearance device for containers having hazardous fills, such as mines, comprising a housing assembly having a chamber within the housing assembly. Within the chamber, a surface contact chemical is contained, capable of ensuring that the hazardous fill is consumed. A nose assembly is attached to the housing assembly. The nose assembly is capable of penetrating a container or mine housing, whether the target is located on the surface, under water, or buried under soil or sand. When the device is propelled toward a target, the nose assembly separates from the housing assembly upon contact with a solid mass, either soil/sand or the container. The nose assembly continues and penetrates the container and contacts the hazardous fill. This exposes the hazardous fill sufficiently so that the surface contact chemical can react with the hazardous fill. The surface contact chemical, due to momentum acting upon the device, follows the nose assembly until the hazardous fill is exposed and contacts the hazardous fill, reacts with the fill, causing the fill to be consumed through combustion, deflagration, explosion, or detonation. Regardless, any of these outcomes will defeat the container or mine for future land encroachment of military personnel and equipment.

Figure 1:
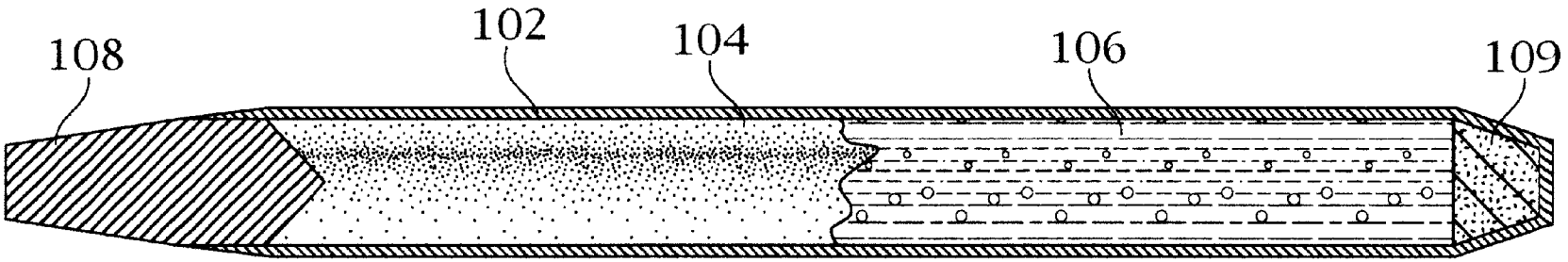
FIG. 1 is a cross-sectional side view of one embodiment of the invention.

Referring to FIG. 1, present invention comprises a housing assembly 102 comprising a chamber 104 therein. A surface contact chemical 106, capable of consuming the hazardous fill within a container, is located within the chamber. A nose assembly 108 is connected to the housing assembly 102. The nose assembly 108 is capable of penetrating the container and contacting the container's hazardous fill so that the fill is exposed sufficiently to allow the surface contact chemical 106 to react with the hazardous fill. When the invention is propelled towards a container, the housing assembly 102 separates from the nose assembly 108 upon contacting a solid mass, allowing free flow of the surface contact chemical 106. This solid mass can be either the housing of a container or soil, earth, or sand under which a container is buried. However, the gravitational forces acting upon the invention, as well as the momentum of the device caused by its propulsion, cause the surface contact chemical 106 to flow behind the nose assembly 108 until the nose assembly 108 exposes the hazardous fill. The surface contact chemical 106 reacts with the hazardous fill, causing the hazardous fill to be consumed. This results in the defeat of the container having a hazardous fill.

The housing assembly 102 may be comprised of a myriad of different materials depending upon the particular type of container having a hazardous fill for which the invention is deployed including plastics, composites such as carbon and kevlar, or metal jackets. The particular material used may be selected by one skilled in the art. The housing assembly 102 may also be designed to react in several different ways upon separation with the nose assembly 108. The housing assembly 102 may remain rigid, peel away or shatter. This reaction will be dependent upon the material selected for the housing assembly 102 and the mission of the invention.

The chamber 104 is basically defined by the hollow housing assembly 102. The volume of the chamber is defined by the amount of surface contact chemical 106 necessary to consume the explosive fill of the mine being defeated. This volume can be selected by one skilled in the art. In a preferred embodiment of the invention, the chamber comprises a volume of about 2 to about 10 ml.

The surface contact chemical 106 is selected so that after a reaction with the hazardous fill material within a container, the hazardous fill is consumed. Such surface contact chemicals 106 may be selected by one skilled in the art. For the defeat of energetic materials contained within mines or other containers, examples of such surface contact chemicals 106 include amines, metal alkyls, strong bases, pyroforic chemicals such as diethylene zinc or triethyl aluminum, and interhalogen compounds. In preferred embodiments of the invention the surface contact chemical 106 comprises potassium hydroxide, diethylene triamine, diethyzinc, or bromine triflouride.

The nose assembly 108 is comprised of a material that will allow the nose assembly 108 to penetrate the target container and expose enough of the hazardous fill within the container to allow a reaction with the surface contact chemical 106. Therefore, the material selected is dependent upon the type of container being attacked and the speed the invention is propelled, and may be selected by one skilled in the art. Examples of nose assembly 108 materials for defeating mines with energetic fills include heavy metals such as tungsten, lead or steel as well as alloys or hybrids with similar physical properties to such heavy metals. The design of the nose assembly 108 can also vary dependent upon the specific mission of the invention. The nose assembly 108 may comprise a solid design, a pre-fragmented design, or a frangible design dependent upon the material selected. In one preferred embodiment, the nose assembly 108 comprises a blunt tip to minimize drag through water or sand prior to contacting a container. In another preferred embodiment, the nose assembly comprises a mass of about 50 percent or greater compared to the mass of the entire invention. Putting the majority of the mass into the nose assembly 108 creates better aerodynamics, hydrodynamics, and enhances penetration capability.

One preferred embodiment of the invention comprises a length of about 6 inches with a diameter of about less than 0.8 inches. The mass of the device of this embodiment would be from about 25 grams to about 100 grams. This embodiment of the invention would allow easy transport and deployment of a large number of devices in order to complete surf and beach zone clearance operations over large areas. The materials noted above for the construction of the housing assembly 102 and the nose assembly 108 are selected to withstand the forces associated with water impact and sand impacts assocatiated with surf and beach zone clearance operations. Water impacts of approximately 3,500 gravities and sand impacts of approximately 60,000 gravities can be expected. In another embodiment of the invention, fins 216 (see FIG. 2) may be attached to the housing assembly 102 to provide aerodynamic stability. In yet another embodiment of the invention, a propulsion means 109 can be connected to the housing assembly 102 in order for the invention to be self-propelled. Examples of propulsion means may include solid propellant (preferred), compressed cryogenic gases, or liquid propellants.

Figure 2:
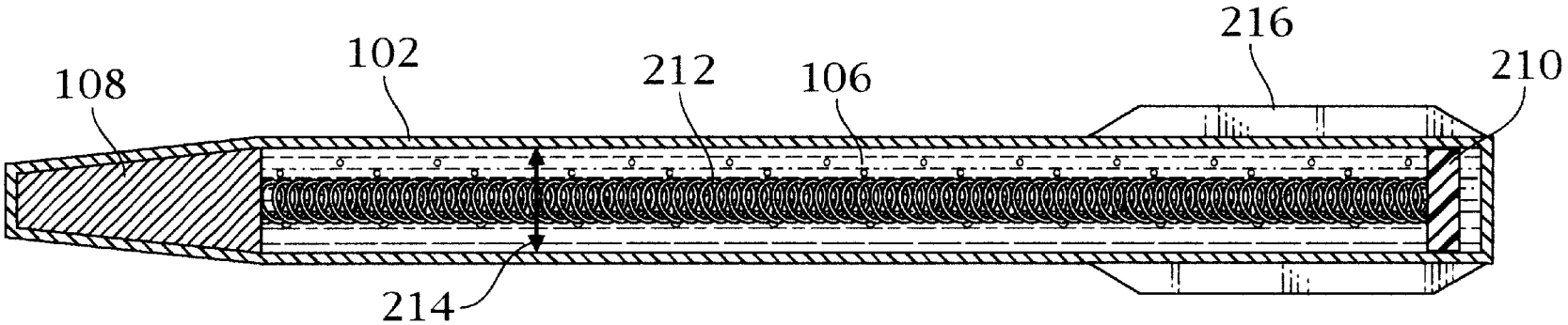
FIG. 2 is a cross-sectional view of an embodiment of the invention including a stopper.

Referring to FIG. 2, this embodiment of the invention includes a stopper 210 located near the end of the housing assembly 102, within the chamber 104, opposite of the nose assembly 108. The stopper may be embodied as one plate or several discs and made of various materials selectable by one skilled in the art. The stopper 210 is attached to the nose assembly 108 through a connector 212. The connector can be substantially rigid or can be a cord or spring. In the embodiment shown in FIG. 2, the stopper 210 comprises an area approximately equal to the cross-sectional area 214 of the chamber 104. The stopper 210 can serve a dual purpose. First, the stopper 210 and connector 212 can provide structural support for the invention during launch. Second, the stopper 210 can act as a guide for the surface contact chemical 106 after the nose assembly 108 separates from the housing assembly 102. In one embodiment of the invention, when the nose assembly 108 contacts a solid mass, the nose assembly 108 is driven down the connector 212 crushing the housing assembly 102. Holes could be placed on the housing assembly 102 wherein the surface contact chemical 106 said holes. In another embodiment, the connector 212 could comprise a stretched spring wherein contact by the nose assembly 108 would cause the spring to compress, and the stopper 210 would push the surface contact chemical 106 forward. In this embodiment, holes along the housing assembly 102 or in the nose assembly 108 could allow the surface contact chemical 106 to be released.

Figure 3:
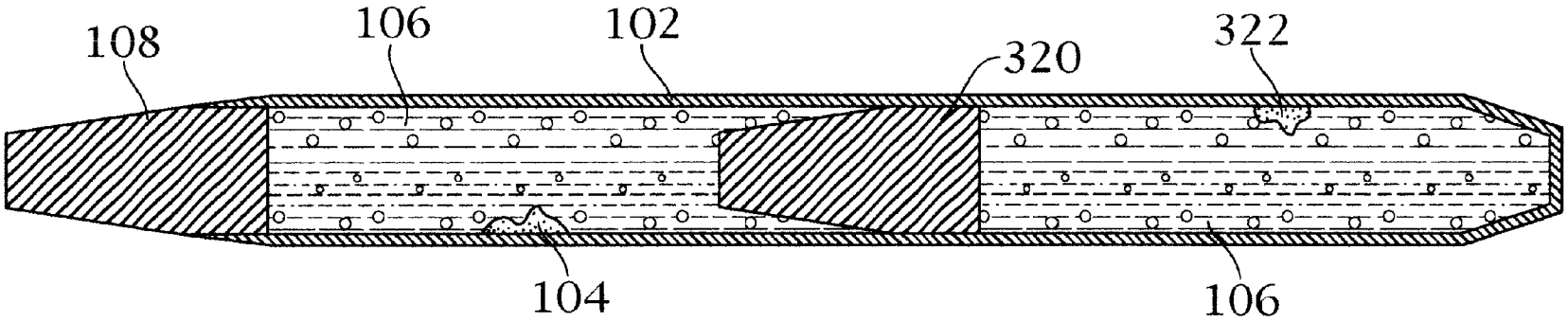
FIG. 3 is a cross-sectional view of an embodiment of the invention comprising two nose assemblies.

Referring to FIG. 3, this embodiment of the invention comprises a second nose assembly 320 within the chamber 104. The second nose assembly 320 possesses sufficient mass to complete any penetration not performed by the nose assembly 108. The second nose assembly can be a myriad of shapes including spherical, flat, etc. which can be selected by one skilled in the art. The second nose assembly 320 defines a second chamber 322. Both the chamber 104 and the second chamber 322 are filled with surface contact chemical 106. The second nose assembly 320 is also capable of penetrating a container and exposing hazardous fill material within a container. This second nose assembly 320 will separate from the housing assembly 102 upon impact with a second mass, where the first nose assembly 108 separated from the housing assembly 102 upon contact with a first solid mass. Therefore, if a mine is buried more than several inches under sand on a beach, surface contact chemical 106 within the chamber 104 may disperse to an extent after the first separation where there is not a sufficient amount of surface contact chemical 106 to completely react with the hazardous fill. However, in the configuration shown in FIG. 3, the second nose assembly 320 would not separate from the housing assembly 102 until it strikes the explosive fill, ensuring that the majority of the surface contact chemical 106 within the second chamber 322 contacts the hazardous fill and the fill is consumed.

The present invention also comprises a method of clearing an area containing multiple mines. One would obtain a plurality of the devices described above and propel these devices toward an area to be cleared of mines. As long as a sufficient number of devices are propelled, every mine should be penetrated by at least one device, and, therefore, defeated. These devices, due to their small size and low weight can be propelled by numerous types of devices selected by one skilled in the art.

The present invention can be used against a myriad of different targets including mines or tanks filled with hazardous chemicals or biological agents. When the target comprises mines, these mines would comprise a hazardous fill that consists of an energetic material. This energetic material may comprises such substances as explosives, propellants, or other reactive materials. The present invention has several advantages over currently employed systems. It does not contain energetic materials, so it does not add to the safety hazard caused by the unexploded ordnance it is designed to neutralize or destroy. The device does not require hand emplacement or initiation of a fuze, so personnel deploying the device are not endangered. The device is lite weight and easily transportable and is not an explosive hazard during transport.

What is described are specific examples of many possible variations on the same invention and are not intended in a limiting sense. The claimed invention can be practiced using other variations not specifically described above.

What is claimed is:

1. A clearance device for containers having a hazardous fill, comprising:

a housing assembly comprising a chamber therein;

a surface contact chemical within the chamber; and, a nose assembly, capable of penetrating the container, connected to the housing assembly, wherein when the device is propelled toward the container creating momentum, the nose assembly separates from the housing assembly upon contact with a solid mass, the nose assembly penetrates the container using only the momentum and contacts the hazardous fill, exposing the hazardous fill so the surface contact chemical, which flows forward due to stopping the momentum of the nose assembly, contacts the hazardous fill, causing the hazardous fill to be consumed.

2. The clearance device of claim 1, comprising a device mass, wherein the nose assembly comprises a mass of about 50 percent or more of the device mass.

3. The clearance device of claim 2, wherein the nose assembly comprises a blunt tip to reduce drag through water.

4. The clearance device of claim 1, wherein the housing assembly shatters when the device contacts a solid mass.

5. The clearance device of claim 1, wherein the housing assembly comprises a plastic material.

6. The clearance device of claim 1, wherein the surface contact chemical is selected from the group consisting of amines, metal alkyls, interhalogens, or bases.

7. The clearance device of claim 6, wherein the surface contact chemical is selected from the group consisting of potassium hydroxide, diethylene triamine, diethylzinc, bromine triflouride, or diethylenetriamine.

8. The clearance device of claim 2, wherein the device mass comprises from about 25 grams to about 100 grams.

9. The clearance device of claim 8, wherein the device comprises a length of about 6 inches.

10. The clearance device of claim 9, wherein the device comprises a diameter of less than about 0.8 inches.

11. The clearance device of claim 1, further comprising fins connected to the housing assembly.

12. The mine clearance device of claim 1, further comprising:

a second nose assembly within the chamber, capable of penetrating the mine housing, defining a second chamber, the second chamber filled with the surface contact chemical, wherein the second nose assembly separates from the housing assembly upon contact with a second solid mass wherein the second nose assembly penetrates a buried container and contacts a hazardous fill, exposing the buried hazardous fill so the surface contact chemical contacts the buried hazardous fill, causing the buried hazardous fill to be consumed.

13. The clearance device of claim 1, further comprising:

a rear end of the housing assembly, substantially opposite of the nose assembly;

a stopper located proximate to the rear end, having an area sufficient to substantially fill a cross-section of the chamber; and, a connector that connects the stopper to the nose assembly wherein the stopper pushes the surface contact chemical toward the hazardous fill.

14. The clearance device of claim 13, further comprising at least one orifice on the housing assembly, wherein the nose assembly moves along the connector and crushes the housing assembly upon contact with a solid mass.

15. The clearance device of claim 13, further comprising at least one orifice on the housing assembly, wherein the connector comprises a stretched spring that decompresses when the nose assembly contacts a solid mass and pulls the stopper toward the nose assembly.

16. The clearance device of claim 1, further comprising means for propulsion connected to the housing assembly.

17. A clearance device for mines having a mine housing and an energetic fill, comprising:

a housing assembly having a chamber therein;

a surface contact chemical comprising diethylenetriamine within the chamber;

a nose assembly, having a blunt tip and comprising a mass of about 50 percent or greater than the device mass, wherein when the device is propelled toward a mine creating momentum, the nose assembly separates from the housing assembly upon contact with a solid mass, the nose assembly penetrates the mine housing using only the momentum and contacts the energetic fill, exposing the energetic fill so the surface contact chemical, which flows forward due to stopping the momentum of the nose assembly, contacts the energetic fill, consuming the energetic fill.

18. The clearance device of claim 17, wherein the housing assembly comprises a length of about 6 inches and a diameter of about 0.5 inches.

19. A method of clearing an area containing multiple mines having mine housings and explosive fills, comprising the steps of:

obtaining a plurality of devices comprising a housing assembly having a chamber therein, a surface contact chemical comprising diethylenetriamine within the chamber, a nose assembly, having a blunt tip and comprising a mass of about 50 percent or greater than the device mass, wherein when the device is propelled toward a mine creating momentum, the nose assembly separates from the housing assembly upon contact with a solid mass, the nose assembly penetrates the mine housing using only the momentum and contacts the energetic fill, exposing the energetic fill so the surface contact chemical, which flows forward due to stopping the momentum of the nose assembly, contacts the energetic fill, causing the energetic fill to be consumed; and, propelling the plurality of devices toward the area containing the multiple mines wherein the energetic fills are all consumed.

* * * * *